US009094752B2

(12) United States Patent
Choi et al.

(10) Patent No.: US 9,094,752 B2
(45) Date of Patent: Jul. 28, 2015

(54) APPARATUS AND METHOD FOR GENERATING DIRECTIONAL SOUND

(75) Inventors: Jung-Woo Choi, Hwaseong-si (KR); Young-Tae Kim, Seongnam-si (KR); Jung-Ho Kim, Yongin-si (KR); Sang-Chul Ko, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 459 days.

(21) Appl. No.: 12/876,963

(22) Filed: Sep. 7, 2010

(65) Prior Publication Data

US 2011/0058677 A1 Mar. 10, 2011

(30) Foreign Application Priority Data

Sep. 7, 2009 (KR) ..... 10-2009-0084072

(51) Int. Cl.
*H04R 5/02* (2006.01)
*H04R 5/04* (2006.01)
*H04R 5/00* (2006.01)

(52) U.S. Cl.
CPC ..... *H04R 5/04* (2013.01)

(58) Field of Classification Search
CPC ..... H04R 1/403; H04R 2430/20; H04R 2203/12; H04R 2201/403; H04R 5/00; H04R 5/02; H04R 5/04; H04S 7/305; H04S 7/30
USPC ..... 381/303, 89, 336, 90, 92, 335, 59; 700/1, 90; 704/500
See application file for complete search history.

(56) References Cited

U.S. PATENT DOCUMENTS

| | | | | |
|---|---|---|---|---|
| 7,515,719 | B2 | 4/2009 | Hooley et al. | |
| 7,974,424 | B2 * | 7/2011 | Kushida et al. | 381/303 |
| 8,094,827 | B2 * | 1/2012 | Baba et al. | 381/63 |
| 2002/0131580 | A1 | 9/2002 | Smith | |
| 2007/0230724 | A1 * | 10/2007 | Konagai et al. | 381/303 |
| 2009/0154723 | A1 | 6/2009 | Choi et al. | |
| 2009/0161880 | A1 * | 6/2009 | Hooley et al. | 381/17 |

FOREIGN PATENT DOCUMENTS

| | | |
|---|---|---|
| JP | 09-230877 | 9/1997 |
| JP | 2002-159097 | 5/2002 |
| JP | 2003-280675 | 10/2003 |

(Continued)

OTHER PUBLICATIONS

Lipshitz, et al., "The Acoustic Radiation of Line Sources of Finite Length," *In Proceedings of the 81st Audio Engineering Society Convention,* Nov. 1986, pp. 1-48.

(Continued)

*Primary Examiner* — Vivian Chin
*Assistant Examiner* — Ammar Hamid
(74) *Attorney, Agent, or Firm* — NSIP Law

(57) ABSTRACT

An apparatus for generating directional sound is provided. By using a time-variant beam pattern, the apparatus may generate constant direct waves in a listening area and may vary reflected waves followed by the direct waves according to time. The apparatus may convolute the time-variant beam pattern with a sound signal, may process an acoustic signal, which may be obtained through convolution, into a multi-channel signal, and may amplify and output the multi-channel signal.

19 Claims, 10 Drawing Sheets

(56) References Cited

FOREIGN PATENT DOCUMENTS

| | | |
|---|---|---|
| JP | 2004-179711 | 6/2004 |
| KR | 10-2004-0004552 | 1/2004 |
| KR | 10-2006-0009090 | 1/2006 |

OTHER PUBLICATIONS

John F. Ramsay, "Rayleigh Distance as a Normalizing Range for Beam Power Transmission," *G-MTT Symposium Digest,* May 1965, pp. 27-32.

* cited by examiner

INPUT SIGNAL

TIME-CONSTANT BEAM PATTERN

TIME-VARIANT BEAM PATTERN

APPARATUS AND METHOD FOR GENERATING DIRECTIONAL SOUND

CROSS-REFERENCE TO RELATED APPLICATION(S)

This application claims the benefit under 35 U.S.C. §119(a) of Korean Patent Application No. 10-2009-0084072, filed on Sep. 7, 2009, the disclosure of which is incorporated herein by reference in its entirety for all purposes.

BACKGROUND

1. Field

The following description relates to an array speaker system, and more particularly, to an apparatus and method for generating sound in which sound output through an array speaker is focused on a particular area by controlling a sound field.

2. Description of the Related Art

An array speaker, which is the combination of a plurality of speakers, can be used to control the direction of reproduced sound or to transmit reproduced sound to a predetermined area. Regarding a speaker array, in general, according to a principle of transmitting sound called "directivity," a plurality of sound source signals are overlapped using the phase difference between the sound source signals such that the intensity of the signals is increased in a particular direction and thus signals are transmitted in a particular direction. In this regard, a plurality of speakers are placed in particular positions and sound source signals output from the respective speakers are controlled, thereby implementing such a directivity.

In the case of a general array system, a desired frequency beam pattern is obtained using filter values such as gains and delays which are calculated for the desired beam pattern, so a fixed beam pattern is only used.

Recently, a personal sound zone technology has garnered a large amount of interest in which noise pollution can be prevented and sound can be transmitted only to a particular listener without an ear phone or a head set. A personal sound zone is formed using the directivity of sound generated by operating a plurality of acoustic transducers. In order to produce the directivity of sound, a time delay or a particular filter value is applied to each input signal of a plurality of speakers, thereby generating a sound beam. Accordingly, sound can be focused towards a particular direction and position.

SUMMARY

In one general aspect, there is provided an apparatus for generating directional sound, the apparatus including: a beam pattern generating unit configured to generate a beam pattern varying according to time, an operation unit configured to: convolute the generated beam pattern with an input sound source signal to generate an acoustic signal through the convolution, and process the acoustic signal into a multi-channel signal, and a speaker array configured to output the multi-channel signal.

The apparatus may further include that the beam pattern generating unit is further configured to generate, as the time-variant beam pattern, a beam pattern including an attenuation rate dependent on a distance.

The apparatus may further include that the beam pattern generating unit is further configured to generate, as the time-variant beam pattern, beam patterns including the same sound pressure at a preset listening position, such that a direct wave includes a magnitude independent of time.

The apparatus may further include that the beam pattern generating unit includes: a beam pattern storage unit configured to store at least two beam patterns including different focusing distances, and a beam pattern selection unit configured to: select different beam patterns at each time interval from the stored beam patterns, and output the selected beam patterns.

The apparatus may further include that the beam pattern generating unit includes: a storage unit configured to store at least two beam patterns including different focusing distances, and a beam pattern synthesizing unit configured to: select at least two beam patterns from the beam patterns stored in the storage unit, assign different weights to the selected beam patterns at each time interval, respectively, synthesize the beam patterns including different weights, and output the synthesized beam pattern.

The apparatus may further include that a sum of the weights assigned to the selected beam pattern is 1.

In another general aspect, there is provided a method of generating a directional sound, the method including: generating a beam pattern varying according to time, performing a convolution on the generated beam pattern with an input sound source signal to generate an acoustic signal obtained through the convolution, processing the generated acoustic signal into a multi-channel signal, and outputting the multi-channel signal.

The method may further include that the time-variant beam pattern includes a beam pattern including an attenuation rate dependent on a distance.

The method may further include that the time-variant beam pattern includes a beam pattern including the same sound pressure at a preset listening position, such that a direct wave includes a magnitude independent of time.

The method may further include that the generating of the beam pattern includes: selecting different beam patterns from pre-stored beam patterns, the pre-stored beam patterns including different focusing distances, at each time interval, and outputting the selected beam patterns.

The method may further include that the generating of the beam pattern includes: selecting at least two beam patterns from pre-stored beam patterns, and respectively assigning different weights to the selected beam patterns at each time interval, synthesizing the beam patterns including different weights, and outputting the synthesized beam pattern.

The method may further include that a sum of the weights assigned to the selected beam pattern is 1.

In another general aspect, there is provided a computer-readable storage medium having stored therein program instructions to cause a processor to execute method for an apparatus for generating directional sound, including: generating a beam pattern varying according to time, performing a convolution on the generated beam pattern with an input sound source signal to generate an acoustic signal obtained through the convolution, processing the generated acoustic signal into a multi-channel signal, and outputting the multi-channel signal.

In another general aspect, there is provided an apparatus for generating directional sound, the apparatus including: a beam pattern generating unit configured to generate a beam pattern varying according to time, an operation unit, including: a convolution engine configured to convolute the generated beam pattern with an input sound source signal to generate an acoustic signal through the convolution, and a multi-channel amplification unit configured to process the acoustic signal into a multi-channel signal, and a speaker array configured to output the multi-channel signal.

Other features and aspects will be apparent from the following detailed description, the drawings, and the claims.

Figure 1:
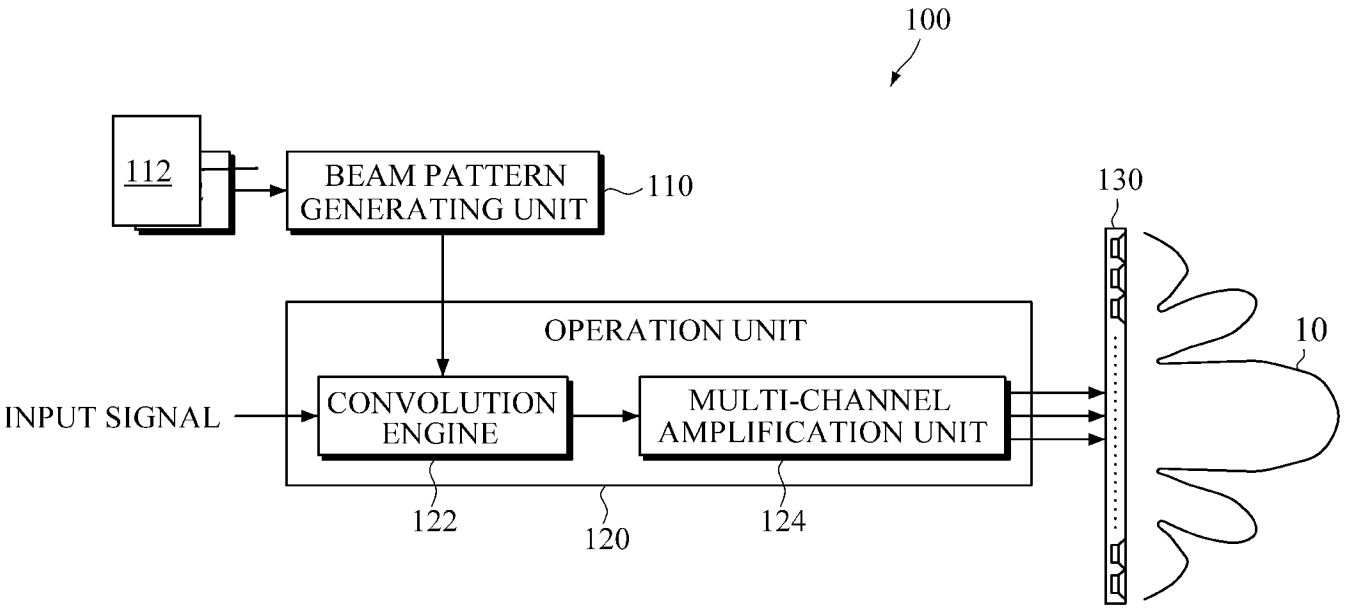
FIG. 1 is a block diagram showing an example apparatus for generating directional sound.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, descriptions of well-known functions and constructions may be omitted for increased clarity and conciseness.

FIG. 1 is a block diagram showing an example apparatus for generating directional sound.

An apparatus 100 for generating directional sound may include a beam pattern generating unit 110, an operation unit 120, and a speaker array 130. The apparatus 100 for generating directional sound may be implemented in various forms such as a television, a desktop computer, a digital multimedia broadcasting (DMB) device, a portable multimedia player (PMP), and a mobile phone. Other devices may include mobile devices such as a cellular phone, a personal digital assistant (PDA), a digital camera, a portable game console, and an MP3 player, a portable/personal multimedia player (PMP), a handheld e-book, a portable laptop PC, a global positioning system (GPS) navigation, and devices such as a desktop PC, a high definition television (HDTV), an optical disc player, a setup box, and the like. This list is intended as a non-exhaustive, nonlimiting example.

When forming and outputting a sound beam indoors, reflected waves (e.g., an echo) are generated due to reflection by wall surfaces, in addition to direct waves. If direct waves with a non-uniform interference pattern are generated by such reflected waves, a frequency response to the sound beam may have a plurality of peaks and troughs.

A high sound pressure may be required in a listening area corresponding to a sound zone, in which sound needs to be focused. A low sound pressure may be required in a quiet area, in which sound should not be heard, as compared with the listening area such that desired sound is heard in the listening area. In one example, a great difference in the sound pressure level between the listening area and the quiet area may verify the superior focusing performance of sound. However, if a trough, due to interference by reflected waves, is generated in a listening area, and the loudness of sound is reduced in the listening area, the difference in sound pressure between the listening area and the quiet area may be decreased. In addition, if a peak is generated in the quiet area, the sound pressure of a quiet area may be increased, so that the difference in sound pressure between the listening area and the quiet area may be reduced.

The apparatus 100 for generating directional sound removes unwanted peaks and troughs of a frequency pattern by use of a beam pattern varying according to time without using a single beam pattern having a fixed travelling distance. For example, the apparatus 100 for generating directional sound may allow the amount of input reflected wave to vary according to time, restricting peaks and troughs from being generated due to interference between the reflected wave and direct wave at a particular frequency. In order to control the amount of input reflected wave, a plurality of beams having different focusing distances may be used. When controlling a sound beam, the focusing distance may represent a distance between a target position, on which sound energy is focused, and the center of the speaker array 130.

As shown in FIG. 1, the beam pattern generating unit 110 may generate a beam pattern having an attenuation dependent of a distance at each time interval based on a predetermined set of beam patterns, such that the amount of input reflected waves reflected from wall surfaces may be changed according to time. In one example, all of the generated beam patterns may be normalized to generate direct waves having the same magnitude at a listening position. A time interval by which the beam pattern changes may be equal to or longer than a sampling period of input signals, but the time interval is not limited thereto.

In order to generate a beam pattern having a shape varying according to time, the beam pattern generating unit 110 may store beam patterns, which are calculated and normalized in advance, in an optional storage 112 of the beam pattern generating unit 110, and may read an individual beam pattern at each time interval. Alternatively, in order to reduce the storage space required to store beam patterns, the beam pattern generating unit 110 may store a few representative beam patterns and generate new beam patterns by combining the beam patterns at each time interval. In one example, the sum of filter weights used when combining the beam patterns is 1, such that direct waves show no change in the listening area.

The operation unit 120 may include a convolution engine 122 and a multi-channel amplification unit 124. The convolution engine 122 may perform a convolution on a beam pattern, which may be updated at each time interval in the beam pattern generating unit 110, with a sound source signal input in real time, outputting a final output. Similar to a conventional speaker array driving unit, signals subjected to convolution may be amplified through the multi-channel amplification unit 124 and then output through the speaker array 130.

The speaker array 130 may generate a sound wave at a given space by operating individual speaker unit using amplified multi-channel signals. The speaker array 130 may be provided in a linear array or a planar array.

A sound beam may reduce the amount of reflected waves, which may be reflected from wall surfaces and degrade the performance of a sound zone, focusing sound on a desired sound zone indoors. Accordingly, without having to increase the speaker array in number or size, a single array using a sound beam may be capable of producing a desired difference in sound pressure over the entire frequency bands indoors.

Figure 2:
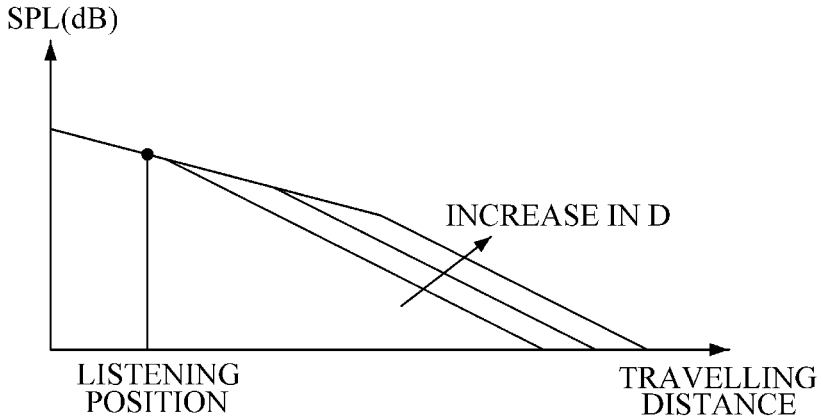
FIG. 2 is a view showing an example of attenuation of sound pressure depending on the distance of beam patterns having different focusing distances in a listening area.

FIG. 2 is a view showing an example attenuation of sound pressure depending on the distance of beam patterns having different focusing distances in a listening area.

A "sound pressure" denotes a force caused by acoustic energy in a physical quantity of pressure. In general, the sound pressure of sound generated in a single speaker falls inversely proportional to the distance, but the sound pressure of a sound beam generated in a speaker array may attenuate up to a particular distance at a lower rate as compared with the signal speaker. The particular distance is called a "Rayleigh distance." When a sound beam is generated, if delay time and gain of signals input into a speaker array speaker are adjusted or a beam pattern optimization is performed to be suitable for a desired focusing distance, a sound focusing distance may be adjusted.

FIG. 2 shows sound pressure levels (SPL) of an acoustic signal according to the travelling distance, in which the acoustic signal is transmitted depending on a beam pattern. As shown in FIG. 2, a length of a section in which the sound pressure decreases at a lower rate may be adjusted by changing a focusing distance D of a beam pattern. Accordingly, in order to reduce the amount of reflected waves due to reflection by wall surfaces, the attenuation of sound with distance may be quickened using a sound beam having a short focusing distance. However, in general, a beam pattern having a short focusing distance may produce a beam having a large width in a far-field as shown in FIG. 3.

Figure 3:
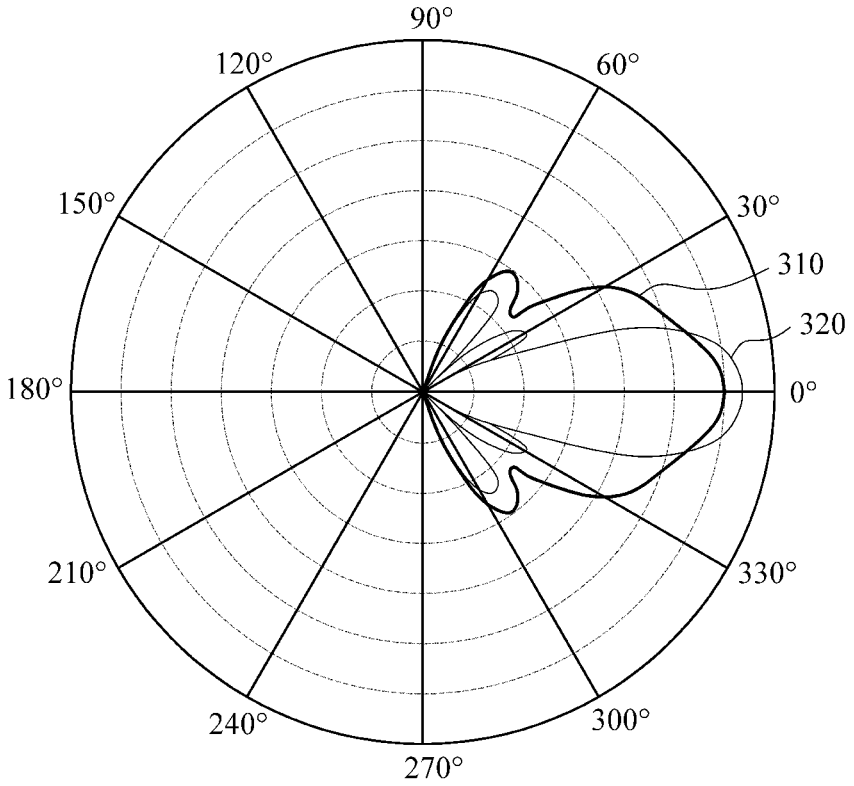
FIG. 3 is a view showing example far-field beam patterns of two sound beam patterns having different focusing distances.

FIG. 3 shows far-field beam patterns of two sound beam patterns having different focusing distances.

In FIG. 3, reference numeral 310 indicates a far-field beam pattern of a sound beam having a focusing distance of 1 meter, and reference numeral 320 indicates a far-field beam pattern of a sound beam having a focusing distance of 10 meters. As shown in FIG. 3, if a focusing is made at a short distance, the attenuation over distance may occur more quickly, but may cause a beam to be spread widely, increasing sound pressure in a quiet area. In this regard, embodiments may shorten focusing distance limits.

As shown in FIG. 1, the apparatus 100 for generating directional sound may remove or reduce peaks and troughs of a frequency response by use of a beam pattern varying according to time without using a single beam pattern having a fixed travelling distance. As shown in FIG. 2, if beam patterns having different focusing distances are normalized such that beam patterns have the same sound pressure, direct waves of sound beams may be perceived with the same magnitude in a listening position. Meanwhile, since reflected waves (e.g., an echo), which are reflected from wall surfaces, reach the listening position after travelling a sufficient distance, the reflected waves of different sound beams may have different sound pressures from each other in the listening position.

That is, in a listening area, direct waves may have the same magnitudes, but reflected waves may have different magnitudes. Meanwhile, when a listener is seated in a quiet area desiring sound to be off, it may be regarded that the listener has deviated from the center of sound beams. Accordingly, if a beam pattern varying according to time is used, the listener may perceive direct waves having different magnitudes in the quiet area. That is, in the quiet area, the sound pressure of the direct waves and the reflected wave may vary according to the focusing distance of a beam pattern.

Figure 4A:
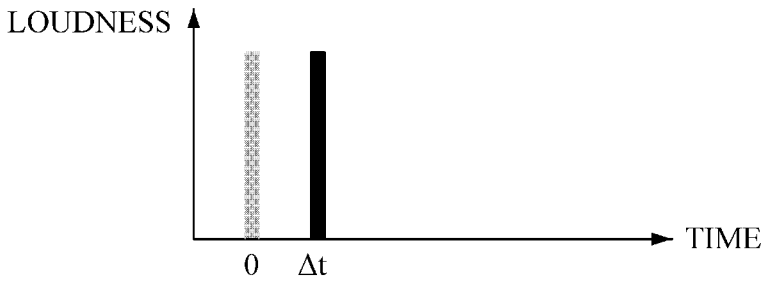
FIG. 4A is a view showing two input pulses.
Figure 4B:
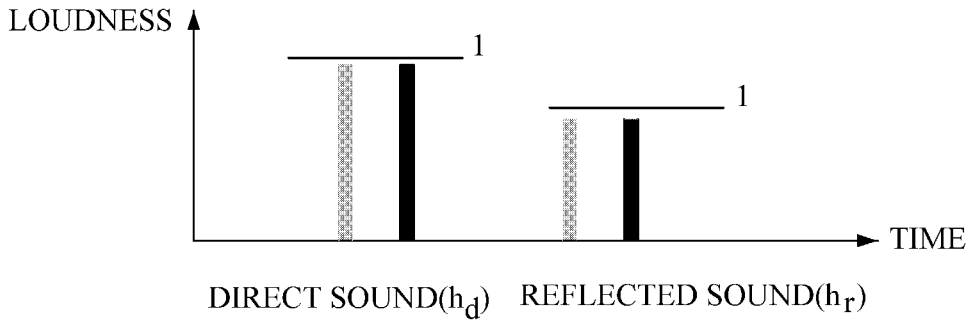
FIG. 4B is a view showing example response patterns obtained by applying time-constant beam patterns to two input pulses.
Figure 4C:
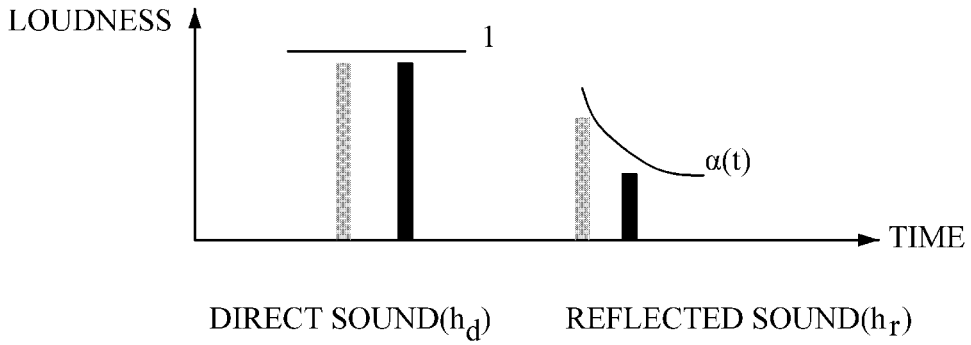
FIG. 4C is a view showing example response patterns obtained by applying time-variant beam patterns to two input pulses.

Restricting of peaks and troughs in a frequency response using a beam pattern varying according to time will be described with reference to FIGS. 4A to 4C. FIG. 4A is a view showing two input pulses, FIG. 4B is a view showing example response patterns obtained by applying time-constant beam patterns to two input pulses, and FIG. 4C is a view showing example response patterns obtained by applying time-variant beam patterns to two input pulses.

A room impulse response corresponding to a predetermined beam pattern at a listening position, h(t) may be expressed as per Equation 1.

$$h(t)=h_d(t)+h_r(t) \quad \text{[Equation 1]}$$

"$h_d$" represents a direct wave part of the impulse response, and "$h_r$" represents a reflected wave part.

When a sound signal is reproduced through a speaker array, the sound pressure generated at the listening position may be expressed as Equation 2, wherein a sound source signal to be reproduced is s(t).

$$p(t)=(h_d(t)+h_r(t))*s(t) \quad \text{[Equation 2]}$$

Herein, "*" denotes a convolution operation.

As an example of a beam pattern varying according to time, two beam patterns (A and B) may be generated in the form of two pulses having a time delay Δt as shown in FIG. 4A. In this case, an input signal s(t) is expressed according to Equation 3.

$$s(t)=\delta(t)+\delta(t-\Delta t) \quad \text{[Equation 3]}$$

If the same beam pattern is not applied to the two pulses, but beam patterns having different attenuation rates according to distance are applied to the two pulses, respectively, direct waves of two response beam patterns may be the same, but reflected waves of the two response beam patterns may be different due to the difference in attenuation rate of the two beam patterns, and may be expressed as $h_{rA}(t)$ and $h_{rB}(t)$, respectively. If the beam patterns having different attenuation rates according to distance are applied to Equation 2, Equation 4 may be produced as follows.

$$p(t)=(h_d(t)+h_{rA}(t))\delta(t)+(h_d(t)+h_{rB}(t))\delta(t-\Delta t)$$

$$=h_d(t)(\delta(t)+\delta(t-\Delta t))+(h_{rA}(t)\delta(t)+h_{rB}(t-\Delta t)) \quad \text{[Equation 4]}$$

That is, as shown in FIG. 4C, direct wave parts of the two pulses may be reproduced without change, but reflected wave parts of the two pulses may change in magnitude according to time. For example, if a reflected wave component of a beam pattern A is different from a reflected wave component of a beam pattern B by C, $h_{rB}(t)=ch_{RA}(t)$. In one example, the response p(t) shown as Equation 4 may be expressed as Equation 5.

$$p(t)=h_d(t)[\delta(t)+\delta(t-\Delta t)]+h_{rA}(t)[\delta(t)+c\delta(t-\Delta t]$$

$$=h_d(t)[\delta(t)+\delta(t-\Delta t)]+h_{rA}(t)\alpha(t)[\delta(t)+\delta(t-\Delta t)] \quad \text{[Equation 5]}$$

Herein, since $\delta(t)\delta(t-\Delta t)=0$ by the nature of delta functions, $\alpha(t)=\delta(t)+c\delta(t-\Delta t)$, and $\alpha(t)$ represents the amount of attenuation of a beam pattern according to time.

If a sound source s(t) is applied to a beam pattern that changes from a reference beam pattern with $\alpha(t)$, Equation 5 may be expressed as Equation 6.

$$p(t)=h_d(t)s(t)+h_r(t)(\alpha(t)s(t)) \quad \text{[Equation 6]}$$

That is, a direct wave may be reproduced in the form of an input signal without change, but a reflected wave may be output in the form of an input signal subject to an amplitude modulation by $\alpha(t)$.

If an input signal s(t) is amplitude-modulated by $\alpha(t)$, as shown Equation 7, convolution may be performed on frequency responses S(f) and A(f) of the input signal.

$$F[s(t)\alpha(t)]=(S(f)*A(f)) \quad \text{[Equation 7]}$$

As shown above, if convolution is performed on frequency responses S(f) and A(f), frequency responses may be equalized, so that reflected wave parts are equalized. FIG. 4B shows responses obtained by applying a time-invariant beam pattern to input signals shown in FIG. 4A. However, referring to FIG. 4C, if a time-variant beam pattern is applied to input signals, the reflected wave part may be output in an amplitude-modulated form by $\alpha(t)$, different from FIG. 4B. As the reflected wave part is amplitude-modulated by $\alpha(t)$, the reflected wave part may be smoothed in a frequency domain.

Figure 5A:
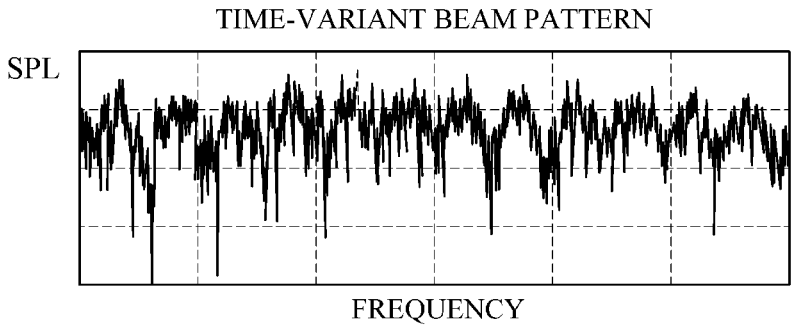
FIG. 5A is a view showing an example frequency response obtained by applying a time-variant beam pattern to an input signal in a listening area.
Figure 5B:
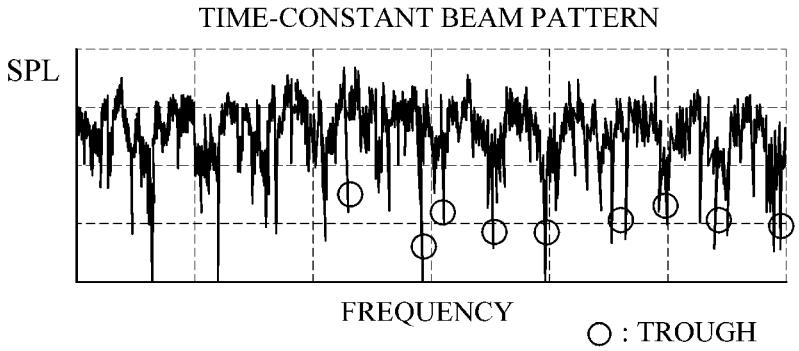
FIG. 5B is a view showing an example frequency response obtained by applying a time-constant beam pattern to an input signal in a listening area.

FIG. 5A is a view showing an example frequency response obtained by applying a time-variant beam pattern to an input signal in a listening area, and FIG. 5B is a view showing an example frequency response obtained by applying a time-constant beam pattern to an input signal in a listening area.

In FIGS. 5A and 5B, a horizontal axis represents a frequency and a vertical axis represents a sound pressure level (SPL). In FIG. 5B, if a time-constant beam pattern is applied to a predetermined input signal having a possibility of causing troughs, troughs may be made in a frequency response of the predetermined signal. However, as shown in FIG. 5A, even if a predetermined input signal has a possibility of causing troughs, if a time-variant pattern is applied to the predetermined input signal, convolution may be performed on a different frequency response due to amplitude-modulation, preventing troughs from being generated. That is, if a time-variant beam pattern is applied to an input signal, the sound pressure in a listening area may not be quickly reduced.

Figure 6A:
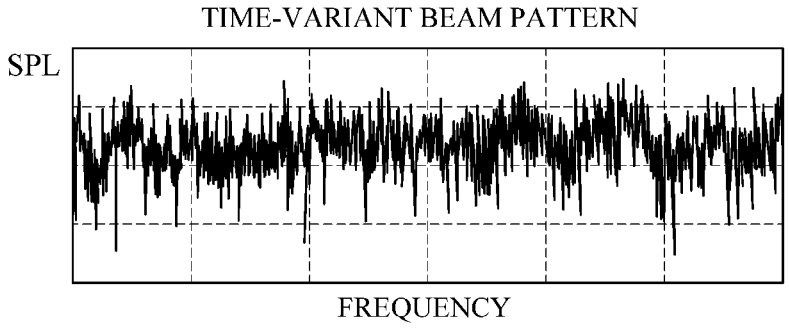
FIG. 6A is a view showing an example frequency response obtained by applying a time-variant beam pattern to an input signal in a quiet area.
Figure 6B:
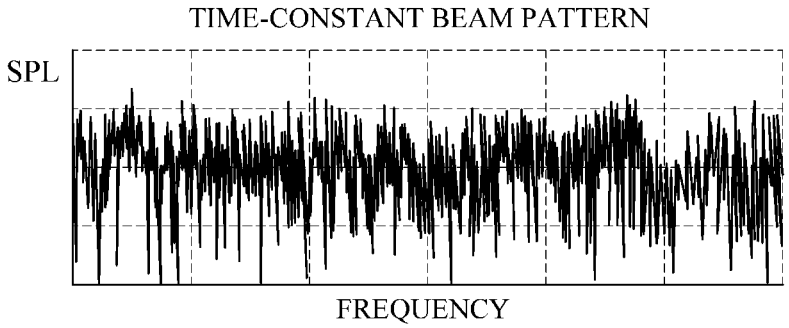
FIG. 6B is a view showing an example frequency response obtained by applying a time-constant beam pattern to an input signal in a quiet area.

FIG. 6A is a view showing an example frequency response obtained by applying a time-variant beam pattern to an input signal in a quiet area, and FIG. 6B is a view showing an example frequency response obtained by applying a time-constant beam pattern to an input signal in a quiet area.

In a quiet area deviated from the focusing center of beams, direct waves and reflected waves of two beam patterns may not be normalized, so that direct waves and reflected waves of the two beam patterns are amplitude-modulated, resulting in equalization of the direct waves and the reflected waves. That is, as compared with input signals having a time-constant beam pattern applied thereto, if a time-variant beam pattern is applied to input signals, non-uniform frequency responses may be smoothed. In particular, the increase of sound pressure due to the peak of sound pressure may be prevented in the quiet area.

Figure 7:
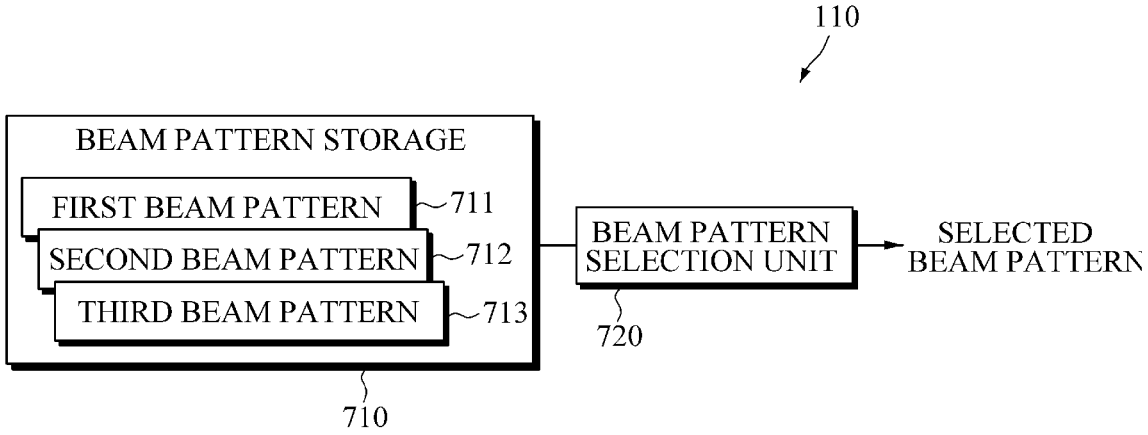
FIG. 7 is a block diagram showing an example beam pattern generating unit of the directional sound generating apparatus shown in FIG. 1.

FIG. 7 is a block diagram showing an example beam pattern generating unit 110 of the directional sound generating apparatus 100 shown in FIG. 1.

The beam pattern generating unit 110 may include a beam pattern storage 710 and a beam pattern selection unit 720.

The beam pattern storage 710 may store at least two beam patterns having different focusing distances. The at least two beam patterns may be normalized such that direct waves having the same magnitude may be generated in a listening position. Although three beam patterns, including a first beam pattern 711, a second beam pattern 712, and a third beam pattern 713 are shown in FIG. 7, the number and shape of beam patterns are not limited thereto. The beam pattern selection unit 720 may select different beam patterns at each time interval and output different beam patterns. The beam pattern selection unit 720 may select an individual beam pattern from the beam pattern storage 710 at a time interval equal to or greater than a sampling interval of an input signal, and may output the selected beam pattern to the operation unit 120 (see FIG. 1).

Figure 8:
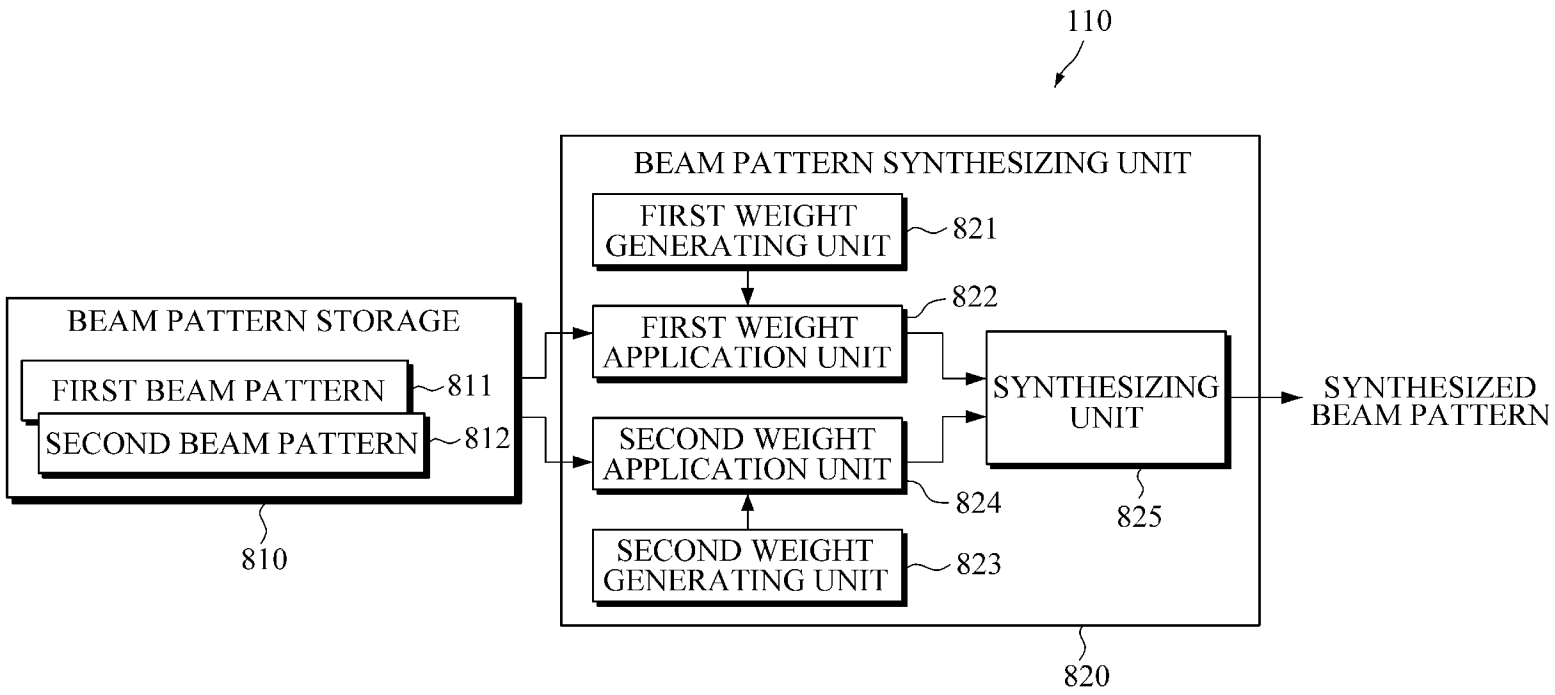
FIG. 8 is a block diagram showing another example beam pattern generating unit of the directional sound generating apparatus shown in FIG. 1.

FIG. 8 is a block diagram showing another example beam pattern generating unit 110 of the directional sound generating apparatus 100 shown in FIG. 1.

The beam pattern generating unit 110 may include a beam pattern storage 810 and a beam pattern synthesizing unit 820.

The beam pattern storage 810 may store at least two beam patterns having different focusing distances. Although two beam patterns, including a first beam pattern 811 and a second beam pattern 812, are shown in FIG. 8, the number and the shape of beam patterns are not limited thereto.

The beam pattern synthesizing unit 820 may include a first weight generating unit 821, a first weight application unit 822, a second weight generating unit 823, a second weight application unit 824, and a synthesizing unit 825. Embodiments may include a respective weight generating unit and weight application unit for each stored beam pattern.

The first weight generating unit 821 may generate a first weight to be applied to the first beam pattern 811. The second weight generating unit 823 may generate a second weight to be applied to the second beam pattern 812. The first weight and the second weight may vary according to time and may be applied to the first beam pattern 811 and the second beam pattern 812, respectively. In addition, the sum of the first weight and the second weight may be set to 1. If there are more than two weights, the sum thereof may be set to 1, as well.

The first weight application unit 822 may apply the first weight on the first beam pattern 811 by multiplying the first beam pattern 811 by the first weight. The second weight application unit 824 may apply the second weight on the second beam pattern 812 by multiplying the second beam pattern 812 by the second weight.

The synthesizing unit 825 may synthesize the first beam pattern having the first weight with the second beam pattern having the second weight, and may output the synthesized result. Since the first weight and the second weight varying according to time may be respectively applied to the first beam pattern 811 and the second beam pattern 812, a beam pattern varying according to time may be output through the synthesizing unit 825. Although the beam pattern generating unit 110 has been described such that two beam patterns are synthesized, the beam generating unit may synthesize three beam patterns or more. In one example, the sum of weights assigned to respective beam patterns is set to 1.

Figure 9:
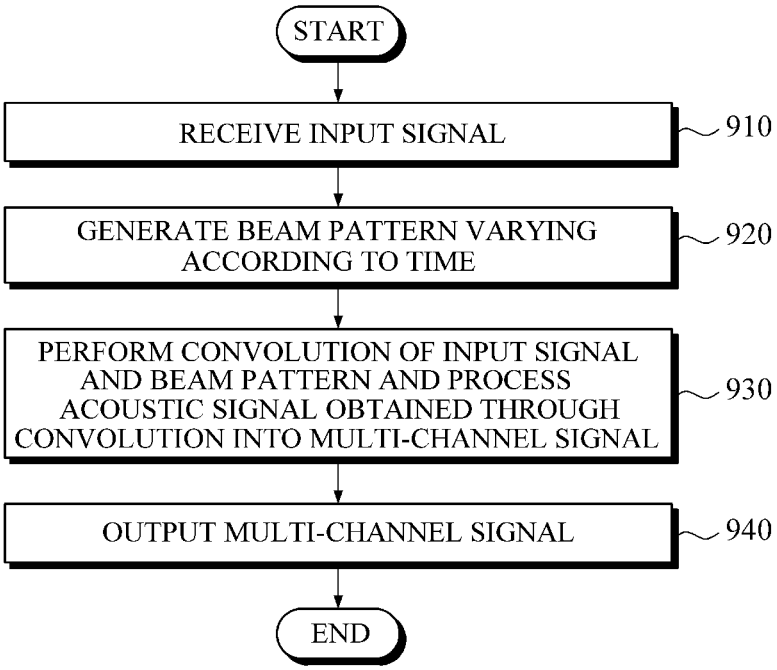
FIG. 9 is a view showing an example method of generating directional sound.

FIG. 9 is a view showing an example method of generating directional sound.

In operation 910, the apparatus 100 for generating directional sound may receive input signals, and in operation 920, the apparatus 100 may generate a beam pattern varying according to time. Operations 910 and 920 do not need to be performed sequentially. For example, in synchronization with the signals, which are input in a digital acoustic sampling unit, different beam patterns may be generated in at least one acoustic sampling unit. The time-variant beam pattern may represent a beam pattern having an attenuation rate varying according to distance. The time-variant beam pattern may represent beam pattern may have the same sound pressure at a preset listening position such that a direct wave has a magnitude independent of time.

The time-variant beam pattern may be generated by selecting a different beam pattern at each time interval from at least two pre-stored beam patterns having different focusing distances. Alternatively, the time-variant beam pattern may be generated by selecting at least two beam patterns from pre-stored beam patterns, respectively assigning different weights to the selected beam patterns at each time interval, and then synthesizing the beam patterns having different weights. The sum of weights assigned to the selected beam patterns In operation 910, the be 1.

In operation 930, the apparatus 100 for generating directional sound may perform convolution on the generated beam pattern with a sound source signal, and may process the acoustic signal obtained through convolution into a multi-channel signal.

In operation 940, the apparatus 100 for generating directional sound may output the multi-channel signal.

The apparatus 100 for generating directional sound may generate a beam pattern, which may allow a direct sound to have a constant magnitude in a listening area, and may vary a reflected wave according to time. The apparatus 100 for generating directional sound may improve the response quality in a listening area and may prevent peaks from being generated in a quiet area. Accordingly, the sound quality in a listening area may be improved while producing a natural sound.

A number of example embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An apparatus for generating directional sound, comprising:

A beam pattern generator configured to generate a beam pattern varying according to time which maintains a magnitude of a direct sound wave and reduces according to time a magnitude of a reflected sound wave;

an operation device configured to convolute the generated beam pattern with an input sound source signal to generate an acoustic signal through the convolution; and process the acoustic signal into a multi-channel signal; and a speaker array configured to output the multi-channel signal.

2. The apparatus of claim 1, wherein the beam pattern generator is further configured to generate, as the time-variant beam pattern, a beam pattern comprising an attenuation rate dependent on a distance.

3. The apparatus of claim 1, wherein the beam pattern generator is further configured to generate, as the time-variant beam pattern, beam patterns comprising the same sound pressure at a preset listening position, such that a direct wave comprises a magnitude independent of time.

4. The apparatus of claim 1, wherein the beam pattern generator comprises:

a beam pattern storage configured to store at least two beam patterns comprising different focusing distances; and a beam pattern selector configured to, select different beam patterns at each time interval from the stored beam patterns and output the selected beam patterns.

5. The apparatus of claim 1, wherein the beam pattern generator comprises:

a storage configured to store at least two beam patterns comprising different focusing distances; and a beam pattern synthesizer configured to select at least two beam patterns from the beam patterns stored in the storage, assign different weights to the selected beam patterns at each time interval, respectively, synthesize the beam patterns comprising different weights, and output the synthesized beam pattern.

6. The apparatus of claim 5, wherein a sum of the weights assigned to the selected beam pattern is 1.

7. A method of generating a directional sound, the comprising:

generating a beam pattern varying according to time which maintains a magnitude of a direct sound wave and reduces according to time a magnitude of a reflected sound wave; performing a convolution on the generated beam pattern with an input sound source signal to generate an acoustic signal obtained through the convolution;

processing the generated acoustic signal into a multi-channel signal; and outputting the multi-channel signal.

8. The method of claim 7, wherein the time-variant beam pattern comprises a beam pattern comprising an attenuation rate dependent on a distance.

9. The method of claim 7, wherein the time-variant beam pattern comprises a beam pattern comprising the same sound pressure at a preset listening position, such that a direct wave comprises a magnitude independent of time.

10. The method of claim 7, wherein the generating of the beam pattern comprises:

selecting different beam patterns from pre-stored beam patterns, the pre-stored beam patterns comprising different focusing distances, at each time interval; and outputting the selected beam patterns.

11. The method of claim 7, wherein the generating of the beam pattern comprises:

selecting at least two beam patterns from pre-stored beam patterns;

respectively assigning different weights to the selected beam patterns at each time interval;

synthesizing the beam patterns comprising different weights; and outputting the synthesized beam pattern.

12. The method of claim 11, wherein a sum of the weights assigned to the selected beam pattern is 1.

13. A non-transitory computer-readable storage medium having stored therein program instructions to cause a processor to execute a method for an apparatus for generating directional sound, comprising:

generating a beam pattern varying according to time which maintains a magnitude of a direct sound wave and reduces according to time a magnitude of a reflected sound wave; performing a convolution on the generated beam pattern with an input sound source signal to generate an acoustic signal obtained through the convolution;

processing the generated acoustic signal into a multi-channel signal; and outputting the multi-channel signal.

14. An apparatus for generating directional sound, comprising:

a beam pattern generator configured to generate a beam pattern varying according to time which maintains a magnitude of a direct sound wave and reduces according to time a magnitude of a reflected sound wave;

An operation device, comprising: a convolution engine configured to convolute the generated beam pattern with an input sound source signal to generate an acoustic signal through the convolution; and a multi-channel amplifier configured to process the acoustic signal into a multi-channel signal; and a speaker array configured to output the multi-channel signal.

15. The apparatus of claim 4, wherein the focusing distance comprises a distance between a target position, on which sound energy is focused, and a center of the speaker array.

16. The apparatus of claim 1, wherein the beam pattern generator is configured to store beam patterns, which are calculated and normalized in advance, in an optional storage of the beam pattern generator, and read an individual beam pattern at each time interval.

17. The apparatus of claim 16, wherein the operation device is configured to update the convolution of the generated beam pattern with the input sound source signal at each time interval in the beam pattern generator, with a sound source signal in real time.

18. The apparatus of claim 1, wherein the beam pattern generator generates two beam patterns having different attenuation rates according to distance such that when they are applied to two sound pulses, direct waves of two response beam patterns are the same but reflected waves of the two response beam patterns are different due to the difference in attenuation rate of the two beam patterns.

19. The apparatus of claim 1, wherein the beam pattern varying according to time maintains the magnitude of a direct sound wave and simultaneously reduces the magnitude of the reflected sound wave over time.

* * * * *